US010396501B2

(12) United States Patent
Cheng et al.

(10) Patent No.: US 10,396,501 B2
(45) Date of Patent: Aug. 27, 2019

(54) ELECTRICAL CONNECTOR WITH IMPROVED SHIELDING PLATE

(71) Applicant: FOXCONN INTERCONNECT TECHNOLOGY LIMITED, Grand Cayman (KY)

(72) Inventors: Chih-Pi Cheng, New Taipei (TW); Chao-Chieh Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 136 days.

(21) Appl. No.: 15/135,487

(22) Filed: Apr. 21, 2016

(65) Prior Publication Data

US 2016/0315422 A1 Oct. 27, 2016

(30) Foreign Application Priority Data

Apr. 21, 2015 (CN) ..... 2015 2 0242634 U

(51) Int. Cl.
*H01R 13/658* (2011.01)
*H01R 13/6581* (2011.01)
(Continued)

(52) U.S. Cl.
CPC ..... *H01R 13/6581* (2013.01); *H01R 13/6585* (2013.01); *H01R 13/6594* (2013.01);
(Continued)

(58) Field of Classification Search
CPC ..... H01R 13/6582; H01R 13/6581; H01R 13/6585; H01R 13/6594
See application file for complete search history.

(56) References Cited

U.S. PATENT DOCUMENTS 8,968,031 B2 * 3/2015 Simmel ..... H01R 13/659 439/108
9,496,664 B2 * 11/2016 Little ..... H01R 13/6587
(Continued)

FOREIGN PATENT DOCUMENTS

CN 203859275 10/2014
CN 204304075 4/2015
(Continued)

*Primary Examiner* — Felix O Figueroa
(74) *Attorney, Agent, or Firm* — Wei Te Chung; Ming Chieh Chang

(57) ABSTRACT

An electrical connector includes a terminal seat loaded with a plurality of terminals and a shielding plate. The terminal seat includes a base and a mating tongue extending from the base, the mating tongue defines two opposite mating surfaces, a confronting surface and two opposite sides connecting with the mating surfaces and the confronting surface. The terminals include contacting sections exposing upon the mating surfaces and leg sections out of the base. The shielding plate includes a main sheet disposed between the mating surfaces and two thickening sections, the two thickening sections enclose the two opposite sides of the mating tongue and each provides a side latch at an outer side face thereof. Each thickness defines two opposite first surfaces connecting with the outer side face thereof, the first surfaces complete the mating surfaces of the mating tongue.

1 Claim, 12 Drawing Sheets

(51) Int. Cl.

| | |
|---|---|
| ***H01R 13/6585*** | (2011.01) |
| ***H01R 13/6594*** | (2011.01) |
| ***H01R 24/62*** | (2011.01) |
| *H01R 107/00* | (2006.01) |
| *H01R 12/72* | (2011.01) |

(52) U.S. Cl.
CPC ..... *H01R 24/62* (2013.01); *H01R 12/721* (2013.01); *H01R 2107/00* (2013.01)

(56) References Cited

U.S. PATENT DOCUMENTS

| | | | | |
|---|---|---|---|---|
| 2015/0244111 | A1 | 8/2015 | Ju et al. | |
| 2015/0295362 | A1* | 10/2015 | Tziviskos ..... | H01R 13/6581 439/607.01 |

FOREIGN PATENT DOCUMENTS

| | | | |
|---|---|---|---|
| CN | 204315776 | U | 5/2015 |
| CN | 204441556 | U | 7/2015 |
| CN | 204696302 | U | 10/2015 |
| CN | 105470782 | A | 4/2016 |

* cited by examiner

ELECTRICAL CONNECTOR WITH IMPROVED SHIELDING PLATE

BACKGROUND OF THE INVENTION

1. Field of the Invention

The present disclosure relates to an electrical connector with an improved shielding plate.

2. Description of Related Art

CN Patent Issued No. 203859275U disclose a USB Type C connector which includes a first terminal module, a second terminal module and a shielding plate sandwiched between the first and second terminal modules to electrically isolate the first and second terminals. The shielding plate forms a cutting surface at lateral sides thereof which are defined as side latches. The shielding plate has a thickness less than 0.02 mm. It is believed that the side latches of the shielding plate will scrap a pair of plug latches of a mating connector. Moreover, the plug latch will wear the insulating mating tongue fitly surrounding the terminals and the shielding plate.

In view of the above, an improved electrical connector is desired to overcome the problems mentioned above.

SUMMARY OF THE INVENTION

Accordingly, an object of the present disclosure is to provide a an electrical connector with an improved shielding plate.

According to one aspect of the present disclosure, an electrical connector comprises a terminal seat loaded with a plurality of terminals and a shielding plate. The terminal seat comprises a base and a mating tongue extending from the base, the mating tongue defines two opposite mating surfaces, a confronting surface and two opposite sides connecting with the mating surfaces and the confronting surface. The terminals comprise contacting sections exposing upon the mating surfaces and leg sections out of the base. The shielding plate comprises a main sheet disposed between the mating surfaces and two thickening sections, the two thickening sections enclose the two opposite sides of the mating tongue and each provides a side latch at an outer side face thereof, each thickness defines two opposite first surfaces connecting with the outer side face thereof, the first surfaces complete the mating surfaces of the mating tongue.

Other objects, advantages and novel features of the disclosure will become more apparent from the following detailed description when taken in conjunction with the accompanying drawings, in which:

DETAILED DESCRIPTION OF THE INVENTION

Figure 1:
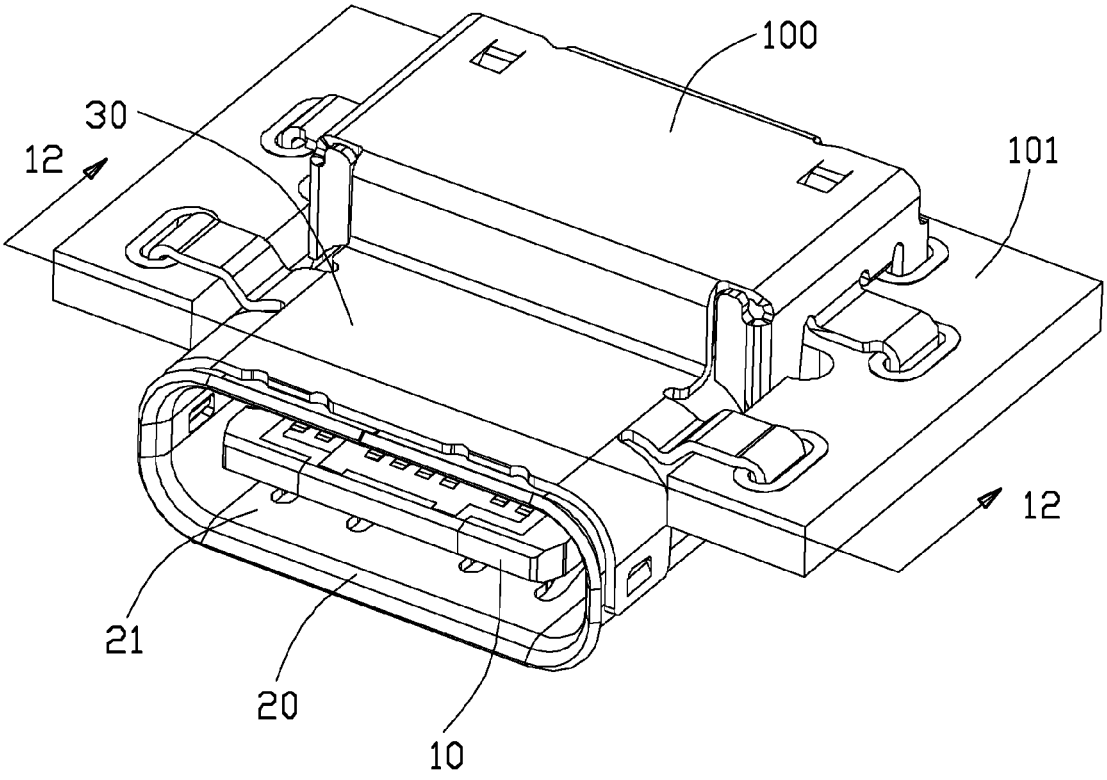
FIG. 1 is a front perspective view of an electrical connector mounted on a printed circuit board in accordance with a preferred embodiment of the present disclosure.
Figure 2:
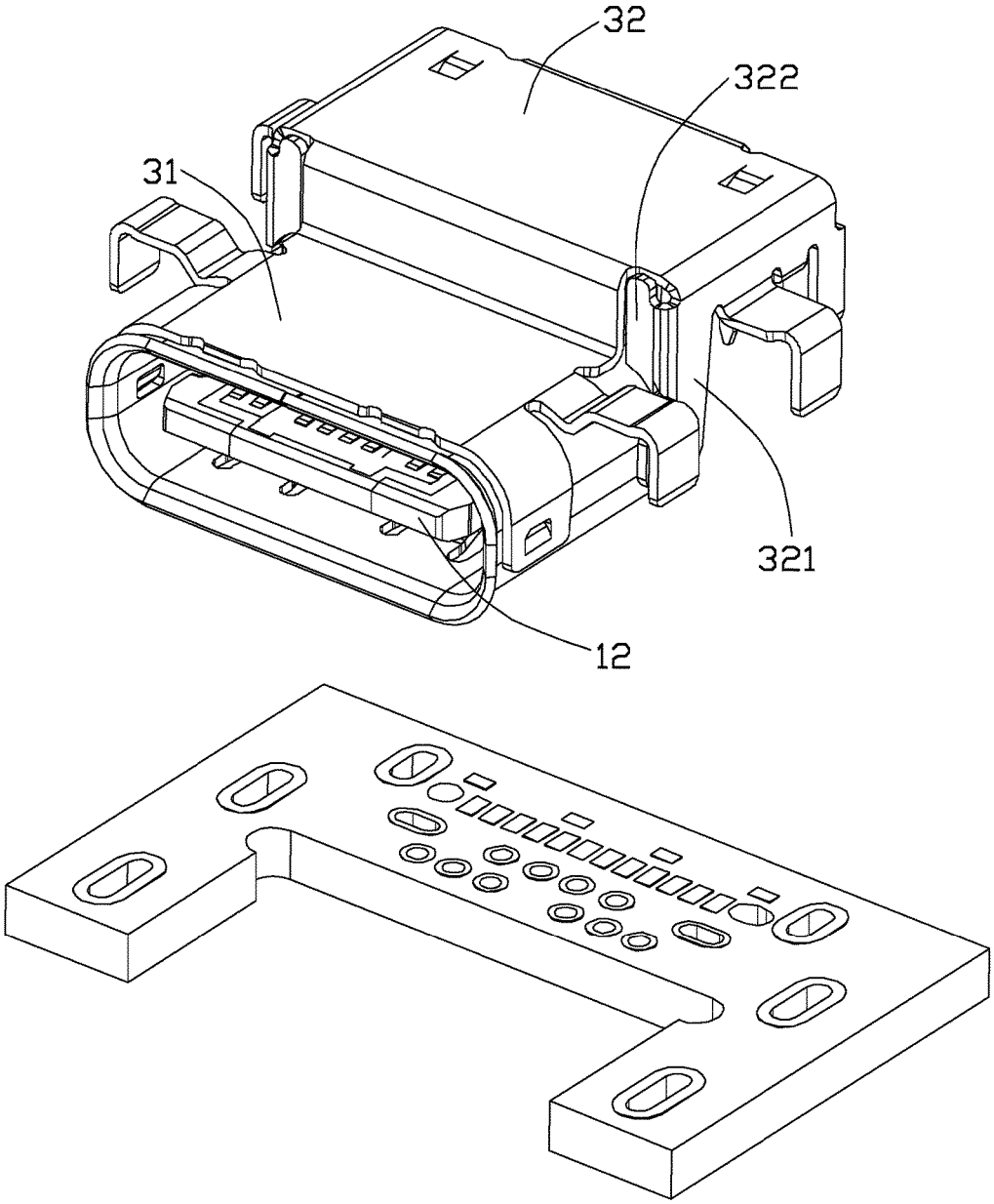
FIG. 2 is a front exploded perspective view of the electrical connector and the printed circuit board in FIG. 1.
Figure 3:
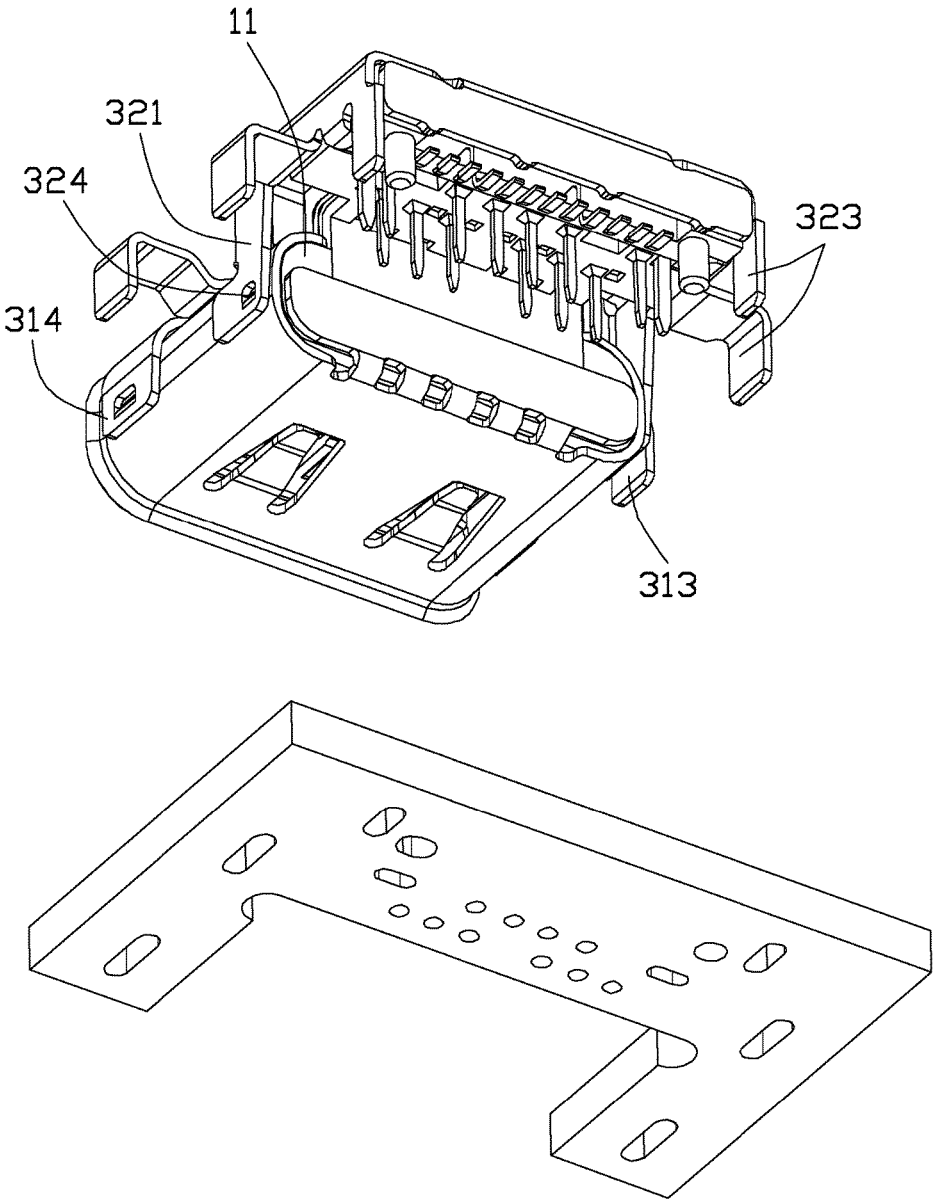
FIG. 3 is a rear exploded perspective view of the electrical connector and the printed circuit board in FIG. 1.
Figure 4:
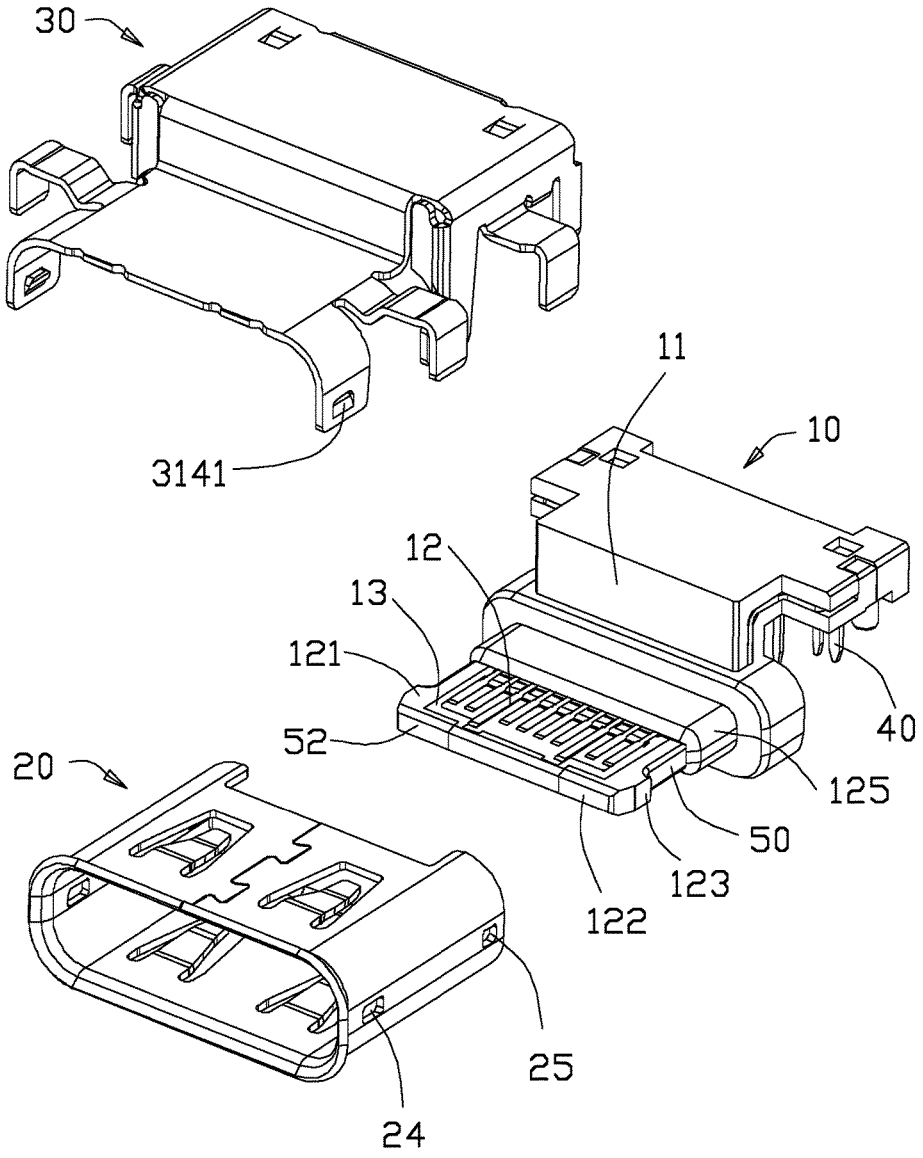
FIG. 4 is a front exploded perspective view of the electrical connector in FIG. 1.
Figure 5:
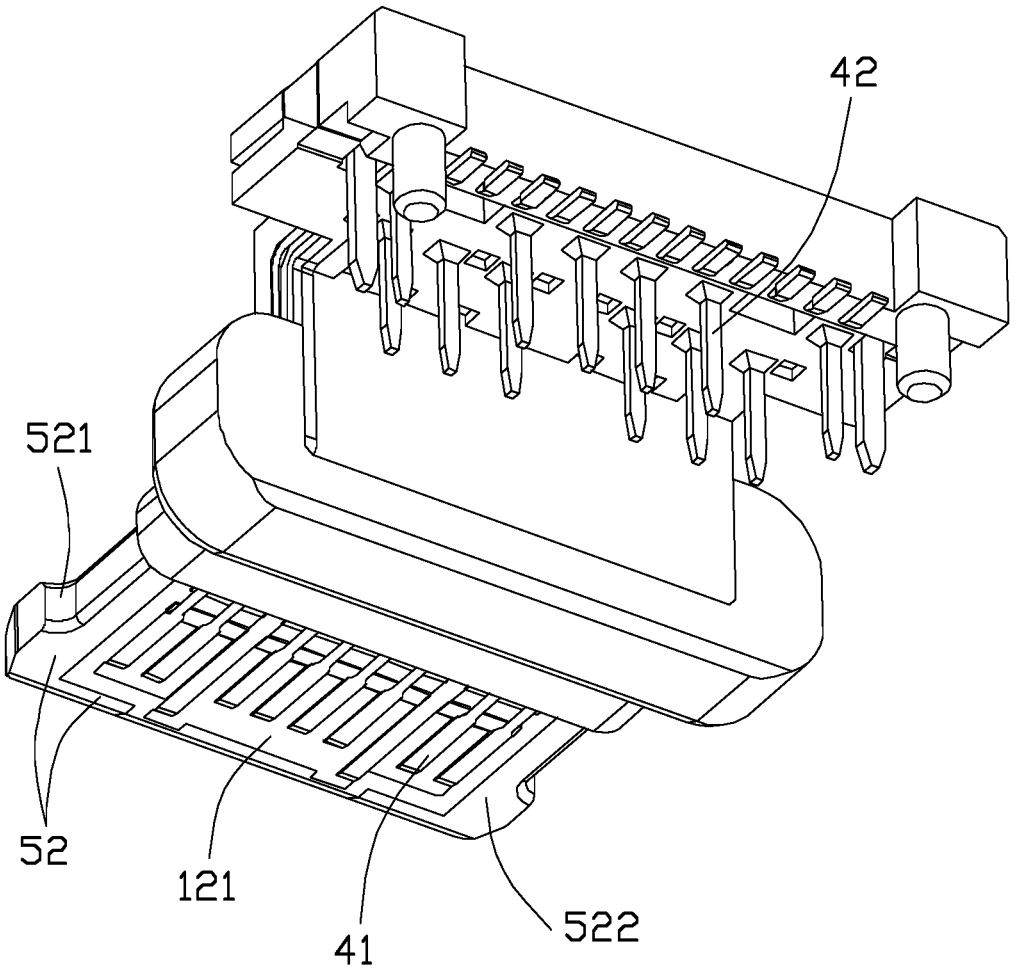
FIG. 5 is a rear perspective view of the terminal seat in FIG. 4.

Reference will now be made to the drawings to describe a preferred embodiment of the present disclosure in detail.

Please referring to FIGS. 1 through 4, an electrical connector 100 is disclosed to be mounted in a large notch of a printed circuit board 101. The connector 100 comprises a terminal seat 10, a metallic shell 20 surrounding the terminal seat 10 to define a mating cavity 21 among the shell 20 and the seat 10, and a metallic bracket 30. The bracket 30 is soldered on a top of the shell 30. The terminal seat 10 comprises a base 11 and a mating tongue 12 extending from the base and into the mating cavity 21. The bracket 30 comprises a front portion 31 covering on the top of the shell 20 and a rear portion 32 covering on the base 12. A pair of retaining portions 321 extends downwards from each side of the rear portion 32 and retained with the rear edge of side walls of the shell 20 and an auxiliary portion 322 extending from a front edge of the retaining portion 321 to shield a front corner of the base 12 thereof. The shell 20 has no soldering legs for the printed circuit board, so that the shielding function of the shell 20 is good. The front portion 31 and rear portion 32 of the bracket 30 define soldering legs 313, 323 for the printed circuit board 101. A retaining portion 314 with locking tab 3141 extends from each side of the front portion 31 and retained on a locking holes 24 defined a front side of the shell 20. The retaining portion 321 also defines a locking tab 324 to retain on locking holes 25 defined on the rear side Referring to FIGS. 4 through 12, the terminal seat 10 is loaded with terminals 40 and a shielding plate 50. The mating tongue 12 defines two opposite mating surfaces 121, a confronting surface (i.e, front surface) 122 and two opposite side 123 connecting with the mating surfaces 121 and the confronting surface 122. The terminals 40 arranged in two rows comprise contacting sections 41 exposing to the two mating surfaces 121 and leg sections 42 out of the base 11. The shielding plate 50 comprises a main sheet 51 located in the mating tongue 12 and between the opposite mating surfaces 121, and two thickening/thickened sections 52 located at the opposite side of the main sheet 51. The two thickening sections 52 enclose the two opposite sides 123 of the mating tongue and each provides a side latch 521 at an outer side face thereof, each thickness 52 defines two opposite first surfaces 522 connecting by the outer side face thereof, the first surfaces 522 is designed to be enough thickened, so the two first surface 522 is constructed as part of the mating surfaces 121 of the mating tongue 12, i.e., the first surfaces 522 complete the mating surfaces 121 of the mating tongue 12. Each thickening section 52 is in an L shape, a second surface or front surface of the thickening sections completed the confronting surface 122 of the mating tongue.

The main sheet 51 of the shielding plate 50 defines two opposite surfaces 511 and two opening cavity 512 among the surfaces 511 and the thickening sections 52. In a direction perpendicular to the main sheet, the main sheet 51 of the shielding plate is disposed in a middle of the thickening sections 52, so that the two opening cavity 512 is symmetrical. The contacting sections 41 of the terminals are received in the opening cavity 512 and then the opening cavity 512 is filled with a third/final insulator 13 labeled in FIG. 4. Therefore, the mating tongue 12 is formed after the third insulator is cool. The shielding plate 50 remains a front opening 523 at the confronting surface 122 of the mating tongue 12, which is also filled with the third insulator 13. The mating tongue 12 defines a step portion 125 at a root of the mating tongue 12 and the base, which is widen than the mating tongue 12 in a transverse direction and a vertical direction of the connector 100. Part of the shielding plate 50 is embedded in the step portion 125, so that a stronger mating tongue 12 is formed. The terminals 40 include signal terminals 40*s* and grounding terminals 40*g*. The outermost grounding terminals 40*g* is shorter than other terminals, the front ends of the grounding terminals respectively contact corresponding rear ends of the thickening sections 52, so that the thickening sections 52 provided grounding points. The main sheet 51 is forged from a metallic sheet and a remainder of the metallic sheet forms the thickening sections 52. Alternatively, the shielding plate is formed by die-casting, powder metallurgy/pressure or pressureless sintering or other compression/pressure forming process other than forging. The main sheet 51 has a thickness of 0.15 mm, the thickening sections 52 have a thickness of 0.45 mm. The metallic thickening sections 52 provide side latches for a pair of spring latches of a plug connector without any resin portion, so that mating tongue 12 reduce abrasive wear affected by the pair of spring latches of the plug connector. The metallic thickening sections 52 complete the mating surfaces 121 and the confronting surface 122, therefore the mating tongue 12 reduce abrasive wear affected by contacts of the plug connector. In this embodiment, the main sheet 51 further includes an upside-down L-shaped structure behind the mating tongue 12 with a pair of mounting legs for mounting to the printed circuit board.

Figure 6:
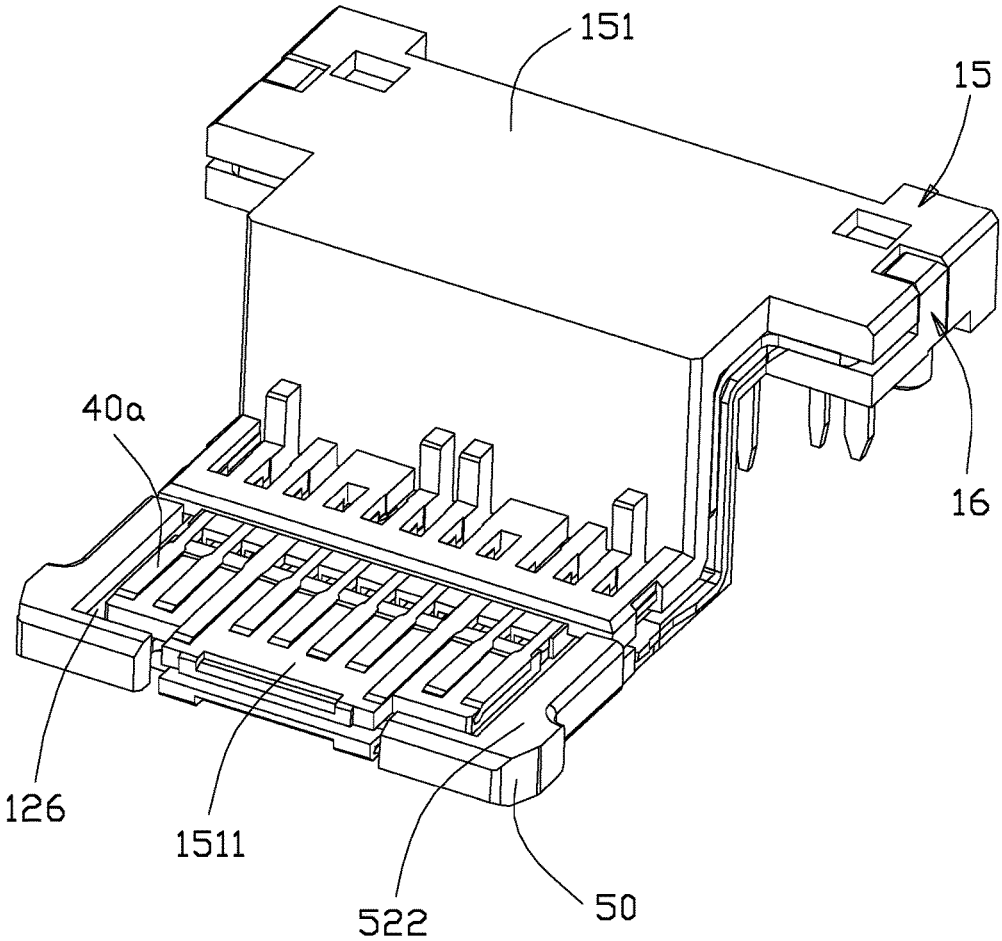
FIG. 6 is a front perspective view of the terminal seat without a third insulator.
Figure 7:
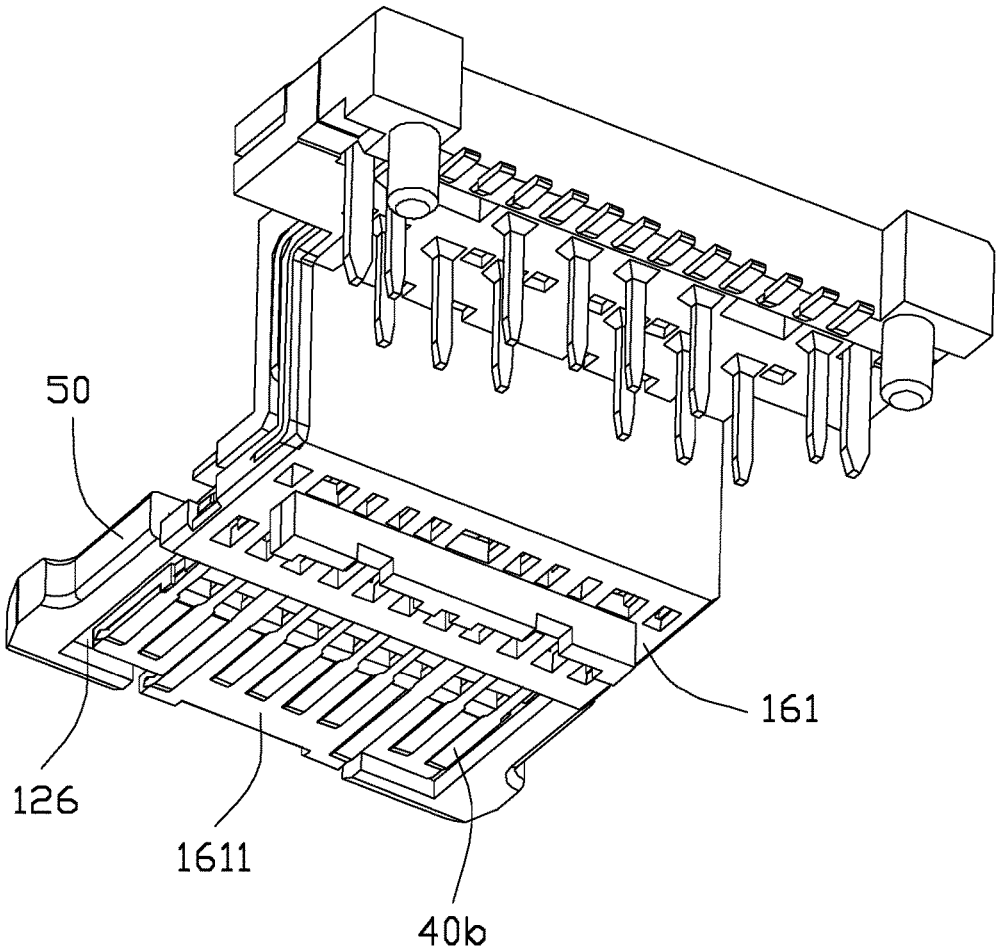
FIG. 7 is a rear perspective view of the terminal seat without the third insulator.
Figure 8:
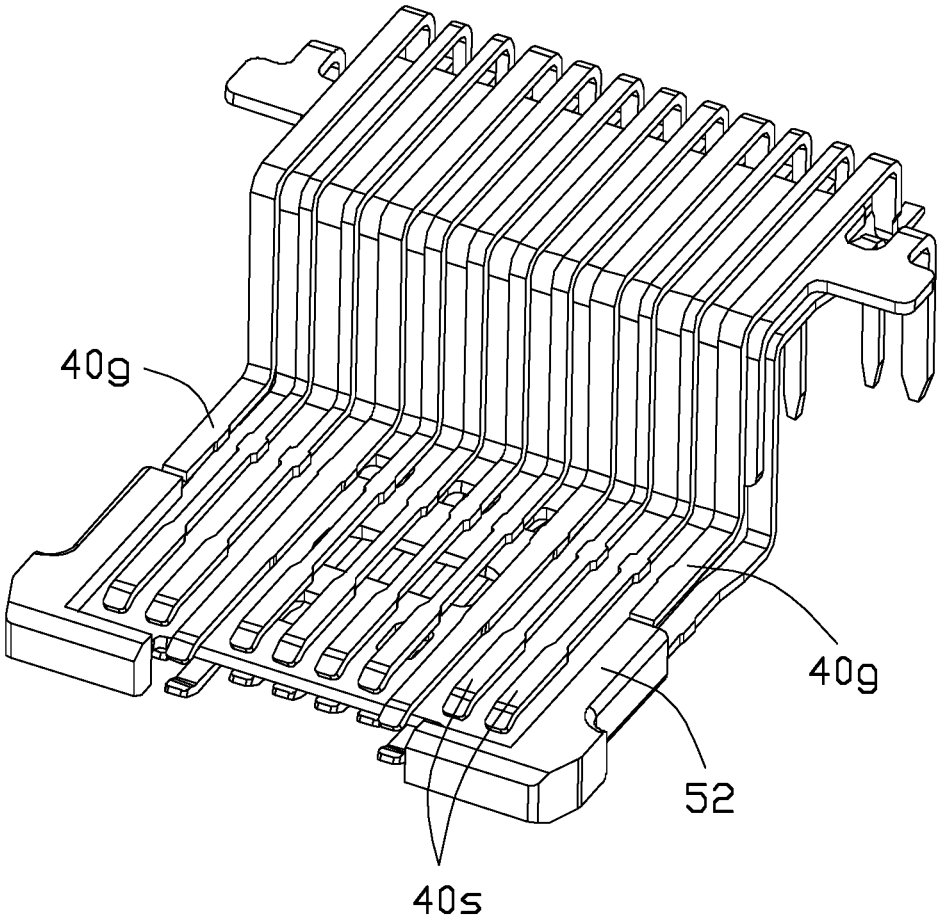
FIG. 8 is a front perspective view of the terminal and the shielding plate.
Figure 9:
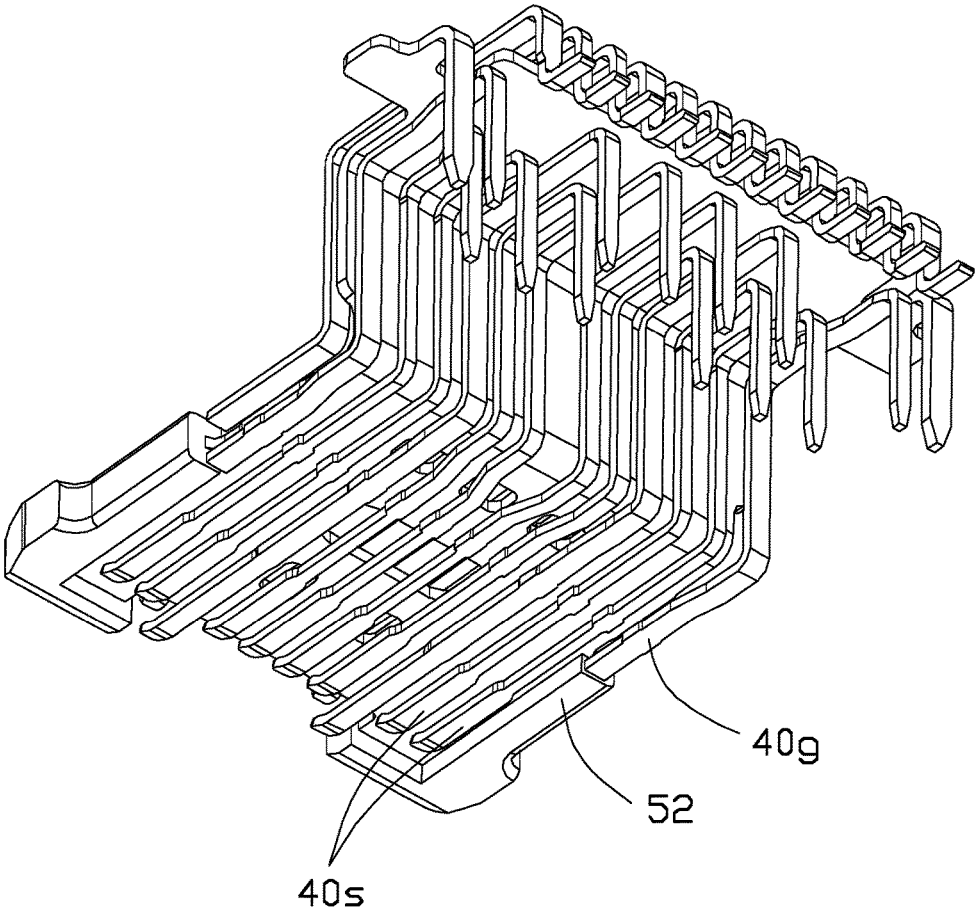
FIG. 9 is a rear perspective view of the terminal and the shielding plate.
Figure 10:
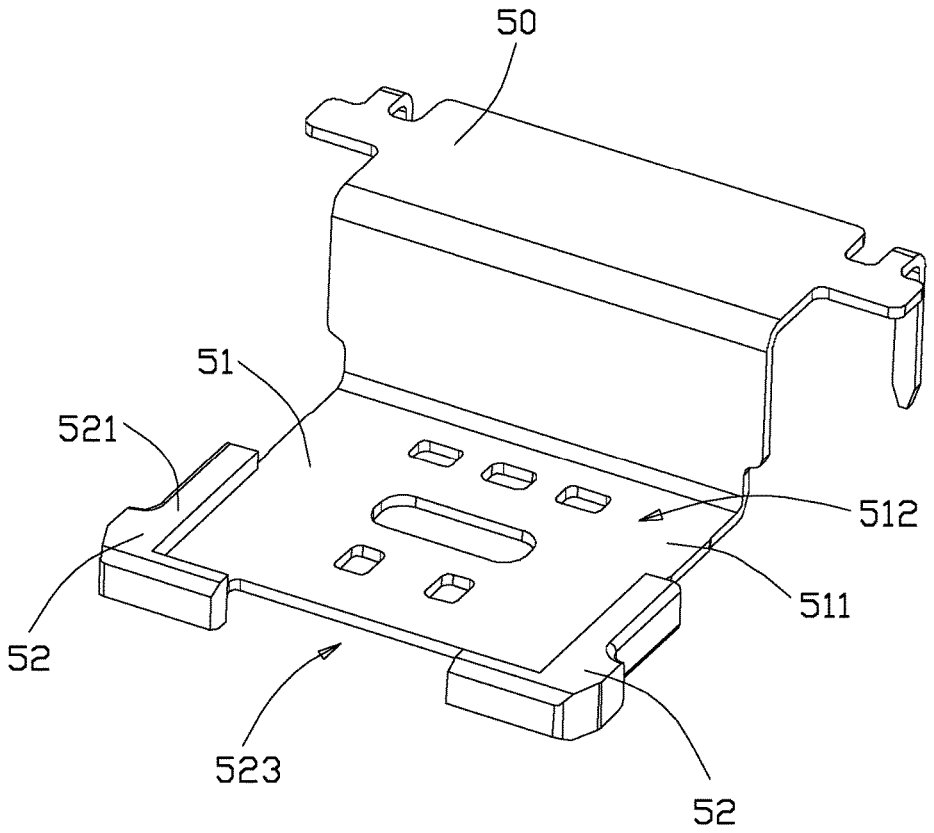
FIG. 10 is a front perspective view of the shielding plate.
Figure 11:
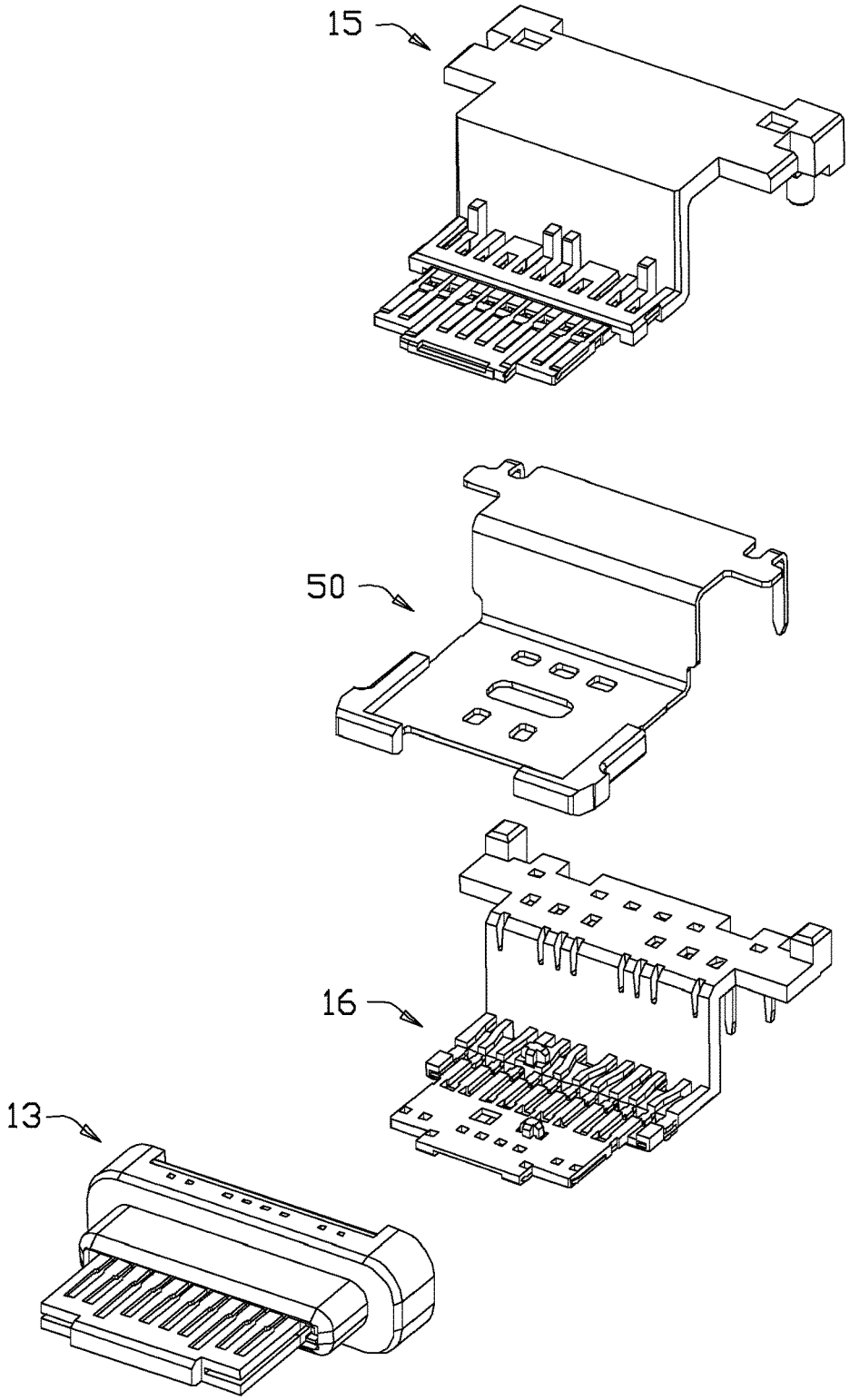
FIG. 11 is an exploded perspective view to show the third insulator, the first terminal module, the second terminal module and the shielding plate therebetween.
Figure 12:
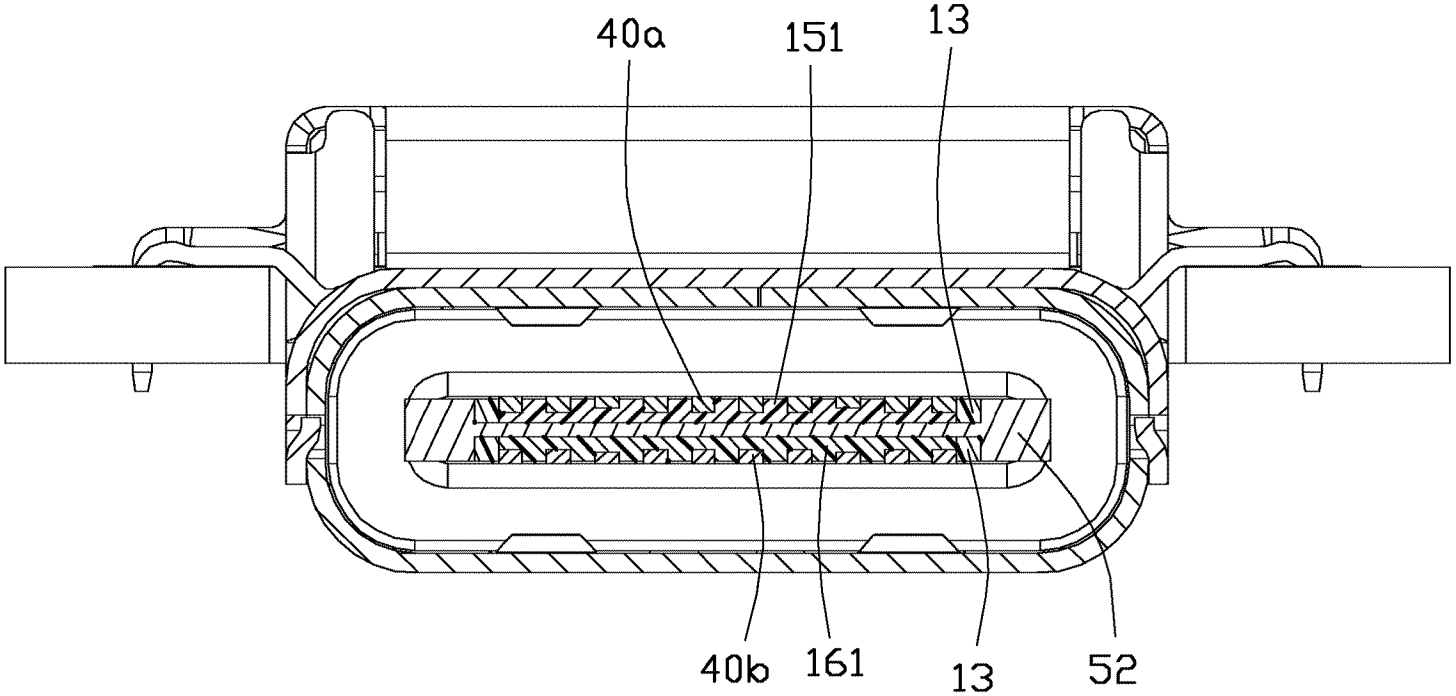
FIG. 12 is a cross-sectional view of the electrical connector of FIG. 1.

Referring to FIGS. 6 and 7, the terminal seat 10 includes a first terminal module 15 with first terminals 40*a* inserted molded with a first/initial insulator 151 via an initial insert-molding process, and a second terminal module 16 with second terminals 40*b* inserted molded with a second/initial insulator 161 via another initial insert-molding process. The first and second insulator 15, 16 respectively extend tongue portions 1511, 1611. The tongue portions 1511, 1611 of the upper and lower terminals module are received in the opening cavity 512. A space 126 is remained between the tongue portions and thickening sections 52. The space 126 is filled with the third insulator 13 via a final insert-molding process, so that a complete mating tongue 12 is formed.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector comprising:

a terminal seat loaded with a plurality of terminals and a shielding plate;

the terminal seat comprising a base and a mating tongue extending from the base, the mating tongue defining two opposite mating surfaces, a confronting surface and two opposite sides connecting with the mating surfaces and the confronting surface;

the terminals comprising contacting sections exposing upon the mating surfaces and leg sections out of the base;

wherein the shielding plate comprises a main sheet disposed between the mating surfaces and extending substantially fully the mating tongue and two thickening sections, the two thickening sections enclosing the two opposite sides of the mating tongue and each provides a side latch at an outer side face thereof, a thickness defines two opposite first surfaces connecting with the outer side face thereof, the first surfaces of the thickening sections complete the mating surfaces of the mating tongue; wherein each of said two thickening sections is in a form of solid configuration; wherein each of the two thickening sections of said shielding plate extends transversely to be located in front of and aligned with an outermost grounding terminal in a front-to-back direction; wherein said grounding terminal is not exposed upon the mating tongue.

* * * * *